US006056063A

United States Patent [19]

Hung

[11] Patent Number: 6,056,063

[45] Date of Patent: May 2, 2000

[54] THERMO-CONTROLLED, SELF-EXPLOSIVE FIRE EXTINGUISHER

[76] Inventor: Chien-Ming Hung, 3rd. Fl., No. 398, Song-Jiang Rd., Taipei, Taiwan

[21] Appl. No.: 09/304,857

[22] Filed: May 5, 1999

[51] Int. Cl.[7] ..... A62C 35/02

[52] U.S. Cl. ..... 169/28; 169/26; 169/51; 169/58

[58] Field of Search ..... 169/26, 28, 36, 169/51, 56, 58

[56] References Cited

U.S. PATENT DOCUMENTS

| | | | |
|---|---|---|---|
| 2,822,877 | 2/1958 | Post | 169/28 |
| 3,918,526 | 11/1975 | Hattori et al. | 169/28 X |
| 4,830,114 | 5/1989 | Jessick et al. | 169/26 |
| 5,868,205 | 2/1999 | Cunningham et al. | 169/26 X |
| 5,894,892 | 4/1999 | Huang | 169/58 X |

*Primary Examiner*—Andres Kashnikow
*Assistant Examiner*—Robin D. Evans
*Attorney, Agent, or Firm*—Bacon & Thomas

[57] ABSTRACT

A thermo-controlled self-explosive fire extinguisher, which comprises a flat, rounded container having an outer thread around the periphery, a container holder having a bottom opening and an inner thread inside the bottom opening, and a fire extinguishing agent filled in the container. After installation of the container holder in a round hole on a board at the ceiling, the outer thread of the container is threaded into the inner thread inside the container holder and disposed substantially in flush with the ceiling. The fire extinguishing agent expands when hot, and the container body explodes when its inside pressure surpasses a predetermined level, causing the fire extinguishing agent to be spread out widely.

11 Claims, 3 Drawing Sheets

THERMO-CONTROLLED, SELF-EXPLOSIVE FIRE EXTINGUISHER

BACKGROUND OF THE INVENTION

The present invention relates to a fire extinguisher for extinguishing a fire, and more particularly to a thermo-controlled, self-explosive fire extinguisher.

Regular fire extinguishers are generally comprised of an air-tight glass container and a fire extinguishing agent filled in the glass container. When in use, fire extinguishers are thrown to the fire by the user, or actuated to fall to the fire by the heat of the fire. FIG. 1 shows a regular thermo-controlled, self-explosive fire extinguisher 9 supported on a bracket 8 at the wall. Because the bracket 8 is not kept from sight, the installation of the fire extinguisher destroys the sense of beauty of the room or house. Further, because the fire extinguisher 9 has a cylindrical shape, the fire extinguishing agent cannot be evenly spread over the area below after explosion of the fire extinguisher. Further, if the fire extinguisher is hung on the wall, the spreading area of the fire extinguishing agent will be hindered by the wall, thereby causing the effective covering area A to be reduced.

SUMMARY OF THE INVENTION

The present invention has been accomplished to provide a thermo-controlled, self-explosive fire extinguisher which eliminates the aforesaid drawbacks. It is one object of the present invention to provide a thermo-controlled, self-explosive fire extinguisher which has a simple structure and good-looking design. It is another object of the present invention to provide a thermo-controlled, self-explosive fire extinguisher which enables the fire extinguishing agent to be evenly spread out when exploded. To achieve these and other objects of the present invention and according to one aspect of the present invention, there is provided a thermo-controlled, self-explosive fire extinguisher comprised of a container, a container holder, and a fire extinguishing agent. The container comprises a flat, rounded container body defining a storage chamber. The container body comprises a bottom center area curved outwards, and an outer thread around the periphery thereof. The container holder comprises a holder body, which holds the container, and a bracket for supporting the container body. The holder body comprises a top side wall, a bottom opening, a downwardly extended peripheral flange around the bottom opening, and an inner thread formed at the peripheral flange on the inside and threaded onto the outer thread at the container body of the container. The fire extinguishing agent is filled in the storage chamber inside the container body. The fire extinguishing agent expands when hot, to break the bottom center area of the container body of the container when the ambient temperature surpasses a predetermined level. When exploded, the fire extinguishing agent is evenly spread over an area blow. According to another aspect of the present invention, the container holder can be installed in a hole on a ceiling board and securely mounted with a bracket to the concrete wall above the ceiling board. According to still another aspect of the present invention, the bracket further comprises an adjustment device, that is operated to adjust the elevation of the container holder. According to still another aspect of the present invention, the container body of the container is made of glass of low expansion coefficient, and the fire extinguishing agent can be a liquid state, power type, or static type fire extinguishing agent, preferably formed of a compound containing ammonium sulfate, urea, ammonium chloride, and sodium carbonate.

According to still another aspect of the present invention, a plurality of hollow balls which are respectively made of glass of low expansion coefficient and stuffed with a second fire extinguishing agent, are arranged inside the storage chamber of the container body of the container. When the balls are ejected with the fire extinguishing agent out of the container body of the container and forced to break after explosion of the container body of the container, the second fire extinguishing agent is spread out to extinguish the fire secondarily. The second fire extinguishing agent contained in the hollow balls and the fire extinguishing agent filled in the storage chamber in the container body of the container can be of same compound, or of different compounds.

DETAILED DESCRIPTION OF THE PREFERRED EMBODIMENT

Figure 1:
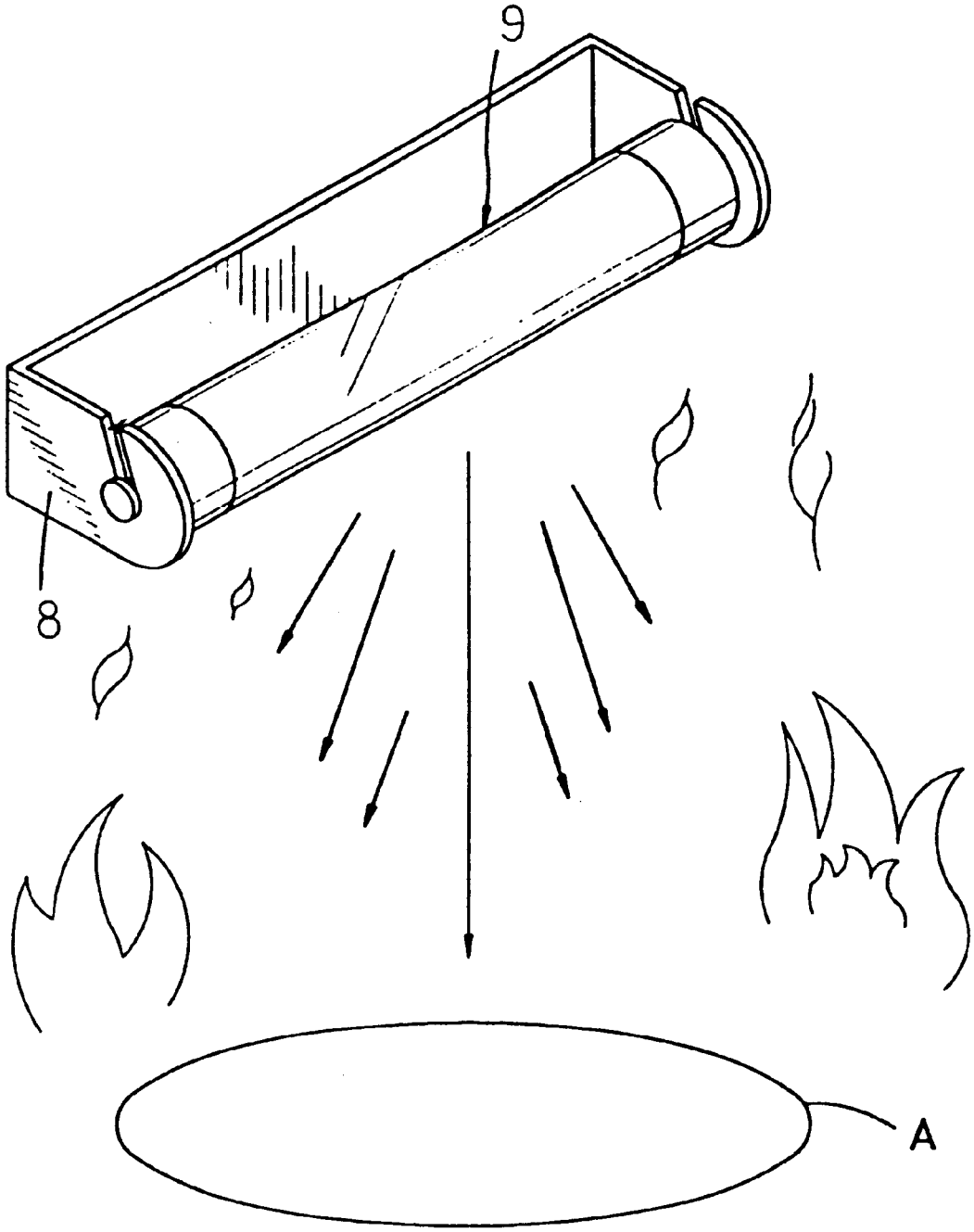
FIG. 1 shows a thermo-controlled, self-explosive fire extinguisher supported on a bracket at the wall according to the prior art.
Figure 2:
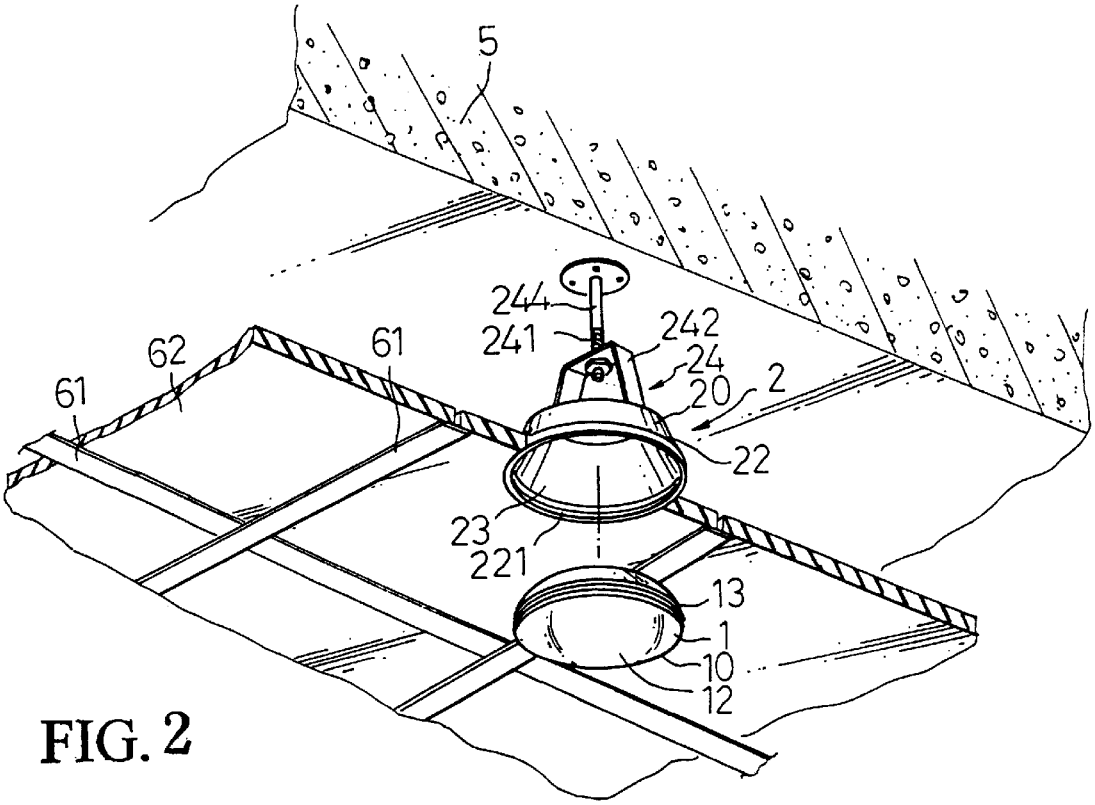
FIG. 2 is an exploded view of a thermo-controlled, self-explosive fire extinguisher according to the present invention.
Figure 3:
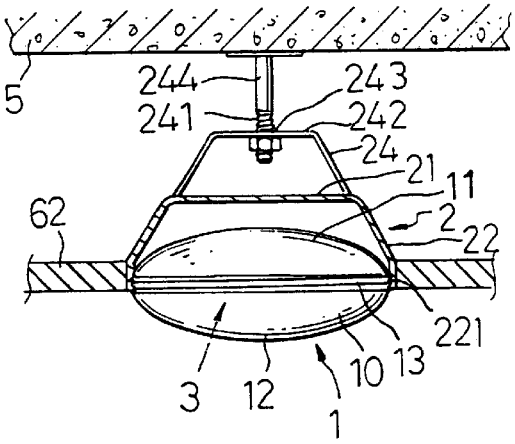
FIG. 3 is a sectional view of the present invention, showing the fire extinguisher installed.

Referring to FIGS. 2 and 3, the present invention comprises a container 1, a container holder 2, and a fire extinguishing agent 3. The container 1 comprises a flat, rounded container body 10, a storage chamber 11 defined within the container body 10, a bottom center area 12 smoothly curved outwards, and an outer thread 13 around the periphery. The container holder 2 comprises a holder body 20, and a bracket 24. The holder body 20 comprises a top side wall 21, a bottom opening 23, a downwardly extended peripheral flange 22 around the bottom opening 23, and an inner thread 221 at the peripheral flange 22 on the inside fitting the outer thread 13 at the container body 10. The bracket 24 comprises a substantially U-shaped frame 242 securely fastened to the top side wall 21 of the holder body 20, the U-shaped frame 242 has a through hole 243 at the center, and a threaded stem 244 having a bottom end downwardly inserted through the through hole 243 at the U-shaped frame 242 and screwed up with an adjustment nut 241 and a top end securely fastened to an overhead concrete wall 5 in a building. By rotating the adjustment nut 241 on the threaded stem 244, the elevation of the U-shaped frame 242 and the container 1 is adjusted relative to the threaded stem 244. The fire extinguishing agent 3 is a compound containing ammonium sulfate, urea, ammonium chloride, and sodium carbonate, and filled in the storage chamber 11 inside the container body 10 of the container 1. The container body 10 of the container 1 is made of glass of low expansion coefficient.

Referring to FIGS. 2 and 3 again, the gypsum plaster ceiling board 62 which is supported on a steel framework 61 below the concrete wall 5 is made with a round hole for receiving the container holder 2, then the threaded stem 244 is securely fastened to the concrete wall 5 above the gypsum plaster ceiling board 62, and then the nut 241 is rotated to adjust the elevation of the container 1, permitting the lowest edge of the peripheral flange 22 to be disposed in flush with the bottom side of the gypsum plaster ceiling board 62, and then the container 1 is fastened to the container holder 2 by threading the outer thread 13 at the container body 10 into the inner thread 221 at the peripheral flange 22 of the holder body 20. When a fire breaks out, the fire extinguishing agent 3 absorbs heat and expands. When the fire extinguishing agent 3 expands, the inside pressure in the container body 10 is increased. As soon as the inside pressure in the container body 10 reaches a predetermined level, thereby causing the downwardly curved bottom center area 12 of the container body 10 to be broken, and therefore the fire extinguishing agent 3 is spread out evenly to extinguish the fire.

Figure 4:
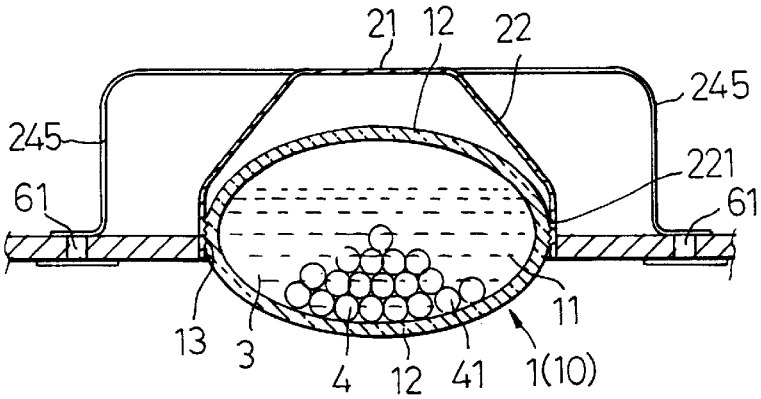
FIG. 4 is a sectional view of an alternate form of the present invention.
Figure 5:
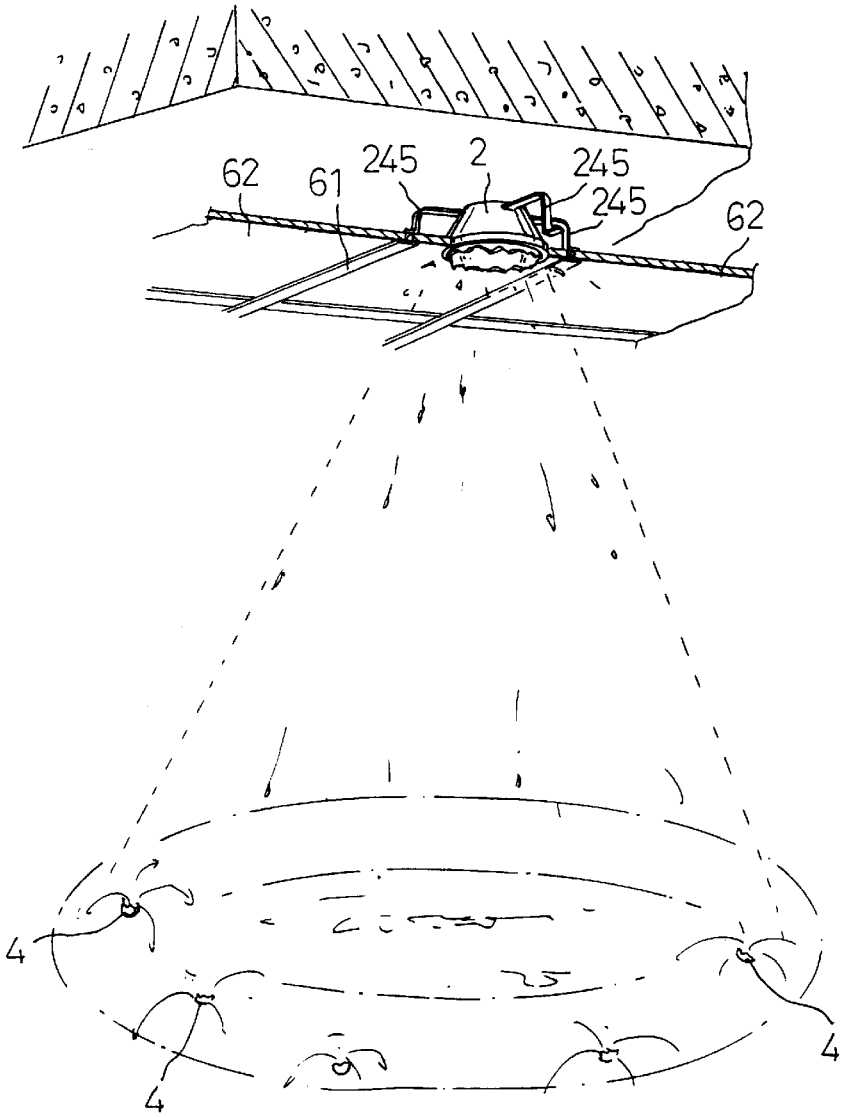
FIG. 5 is an applied view of the fire extinguisher shown in FIG. 4.

FIGS. 4 and 5 show an alternate form of the present invention. According to this alternate form, the bracket of the container holder 2 is comprised of a plurality of curved legs 245 for positioning on the steel framework 61, and a number of balls 4 are filled with the fire extinguishing agent 3 in the storage chamber 11 inside the container body 10 of the container 1. Each of the balls 4 is comprised of a hollow spherical glass shell of low expansion coefficient filled up with a different composition of fire extinguishing agent 41 (see FIG. 4). When the balls 4 are ejected out of the container 1 upon explosion of the container body 10 explodes and spread over the floor, the glass spherical shell of each of the balls 4 is broken, causing the fire extinguishing agent 41 to be spread out over the fire (see FIG. 5) for the secondary extinguish ability.

It is to be understood that the drawings are designed for purposes of illustration only, and are not intended as a definition of the limits and scope of the invention disclosed.

What the invention claimed is:

1. A thermo-controlled, self-explosive fire extinguisher comprising:

a container, said container comprising a flat, rounded container body defining a storage chamber, said container body comprising a bottom center area curved outwards, and an outer thread around the periphery thereof;

a container holder comprising a holder body, which holds said container, and a bracket for supporting said container body, said holder body comprising a top side wall, a bottom opening, a downwardly extended peripheral flange around said bottom opening, and an inner thread formed at said peripheral flange on the inside and threaded onto the outer thread at the container body of said container; and a fire extinguishing agent filled in the storage chamber inside said container body;

wherein said fire extinguishing agent expands when hot, and explodes to break the bottom center area of said container body of said container.

2. The thermo-controlled, self-explosive fire extinguisher of claim 1 wherein said bracket is securely mounted on the top side wall of said holder body.

3. The thermo-controlled, self-explosive fire extinguisher of claim 1 wherein said bracket is comprised of a plurality of legs, said legs each having a fixed end securely connected to said holder body and a free end for supporting on an overhead ceiling structure.

4. The thermo-controlled, self-explosive fire extinguisher of claim 1 wherein said bracket further comprising an adjustment device for adjusting the elevation of said container holder.

5. The thermo-controlled, self-explosive fire extinguisher of claim 4 wherein said adjustment device is a screw member.

6. The thermo-controlled, self-explosive fire extinguisher of claim 1 wherein said container body of said container is made of glass of low expansion coefficient.

7. The thermo-controlled, self-explosive fire extinguisher of claim 1 wherein said fire extinguishing agent is a compound containing at least ammonium sulfate, urea, ammonium chloride, and sodium carbonate.

8. The thermo-controlled, self-explosive fire extinguisher of claim 1 further comprising a plurality of hollow balls respectively stuffed with a second fire extinguishing agent, and arranged inside the storage chamber of the container body of said container.

9. The thermo-controlled, self-explosive fire extinguisher of claim 8 wherein said hollow balls are respectively made of glass of low expansion coefficient.

10. The thermo-controlled self-explosive fire extinguisher of claim 8 wherein the second fire extinguishing agent contained in said hollow balls and the fire extinguishing agent filled in the storage chamber in the container body of said container are of different compounds.

11. The thermo-controlled self-explosive fire extinguisher of claim 8 wherein the second fire extinguishing agent contained in said hollow balls is same as the fire extinguishing agent filled in the storage chamber in the container body of said container.

* * * * *